United States Patent [19]

Mickey et al.

[11] 4,035,940

[45] July 19, 1977

[54] SIGN CONSTRUCTION

[75] Inventors: Edgar G. Mickey; Gerald H. Nelson, both of Houston, Tex.

[73] Assignee: Micknel Manufacturing Inc.

[21] Appl. No.: 647,426

[22] Filed: Jan. 8, 1976

[51] Int. Cl.[2] ..... G09F 7/08

[52] U.S. Cl. ..... 40/140; 40/125 F; 40/125 H

[58] Field of Search ..... 40/145 R, 140, 125 F, 40/63 R, 64 R, 125 H, 125 R, 152, 152.1, 156

[56] References Cited

U.S. PATENT DOCUMENTS

| | | | |
|---|---|---|---|
| 1,824,444 | 9/1931 | Mueller et al. | 40/125 H |
| 2,172,528 | 9/1939 | Auer | 40/140 X |
| 2,841,902 | 7/1958 | Pfundt | 40/125 H |
| 3,336,682 | 8/1967 | Genin | 40/140 X |
| 3,535,807 | 10/1970 | Baldwin | 40/140 |
| 3,561,146 | 2/1971 | Dembar | 40/152 |
| 3,608,221 | 9/1971 | Harris | 40/125 H |
| 3,946,510 | 3/1976 | Schubert | 40/140 |

*Primary Examiner*—John F. Pitrelli
*Attorney, Agent, or Firm*—Pravel, Wilson & Gambrell

[57] ABSTRACT

A segmented sign board comprising a plurality of laminated segments having opposing faces with letter-holding channel members along the upper and lower edges of each segment. The channel members provide means for gripping the edges of the letters inserted into the channels.

3 Claims, 4 Drawing Figures

SIGN CONSTRUCTION

BACKGROUND OF THE INVENTION

Heretofore various signs have been constructed for receiving removable letters, numbers, etc. These have included sign faces wherein the letters have been secured by various means, such as by metal clips, screws, by inserting the edges of the letters into variously shaped channel members which normally hold the letters on the sign face. However, many of the former signs have had problems retaining the letters on the sign face. Frequently, such letters would blow off the sign, particularly if it was a trailer-mounted sign and pulled from place to place. Also, as the letters are relatively expensive, their loss is both an expense as well as a nuisance. Many of the former sign board constructions have required letters having specially shaped tangs or connecting members for connecting them to the sign face.

SUMMARY OF THE INVENTION

Briefly, the present invention comprises a new and improved sign structure which provides a means for gripping the opposite edges of the sign letters to securely hold them on the face of the sign board. Such sign construction comprises one or more letter-carrying segments held together in a perimeter frame. Such segments are laminated with a lightweight slightly compressible plastic foam core, such as polystyrene or the like, with aluminum skin panels glued to the opposite sides of the core block. The upper and lower edges of the core block are grooved or relieved so as to allow slight flexing when compressed into the channel members. The channel is a U-shaped member with the opposite sides of the channel overlapping the outer surface of the aluminum skin of the sign faces. The U-shaped channel member is further relieved on the inner sides of the legs to provide a space for receiving the edges of the letters which are inserted into the channel members surrounding the various core block members forming the sign face. The insertion of the letters into the U-shaped channel members further compresses the core block and the additional compressive force grips the letters' edge to hold them in place.

DESCRIPTION OF THE PREFERRED EMBODIMENT

Figure 1:
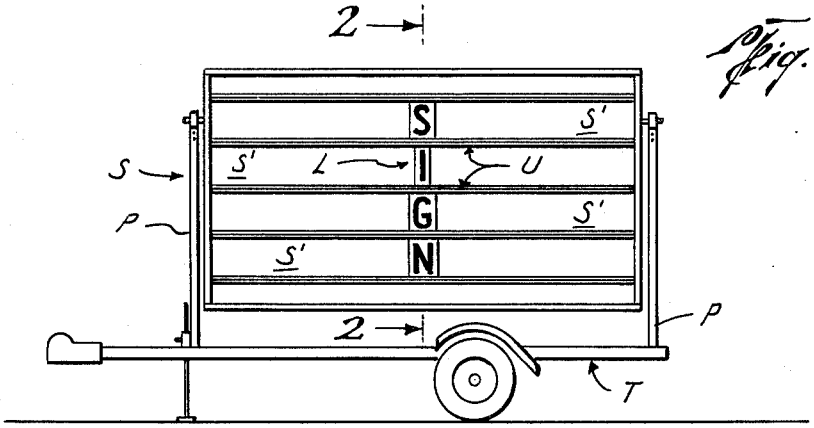
FIG. 1 is a sideview of the sign board of the present invention shown mounted on a trailer.

The sign construction of the present invention is designated generally S in FIG. 1 of the drawings. As shown, such sign comprises a plurality of segments S'. However, it will be appreciated that a sign face can be made of a single segment, or a plurality of such segments shown together, as desired. Letters, numbers or other indicia indicated generally L are affixed to the sign segment S' by inserting their upper and lower edges, respectively, into the upper and lower U-shaped channel members U. Further, as shown, the individual letters L are each made of substantially flat sheet material with the particular letter either being painted on the sheet or, if desired, the letter may be formed of some raised configuration in the otherwise substantially flat sheet material. Further, it will be appreciated that entire words may be formed comprising several letters on a single sheet, if desired.

Further, as shown in the drawings, the sign board S may be pivotally mounted between a pair of upright sign support members or posts P. These posts may be set in the ground, on a building or on a trailer T, as shown in FIG. 1.

Figure 2:
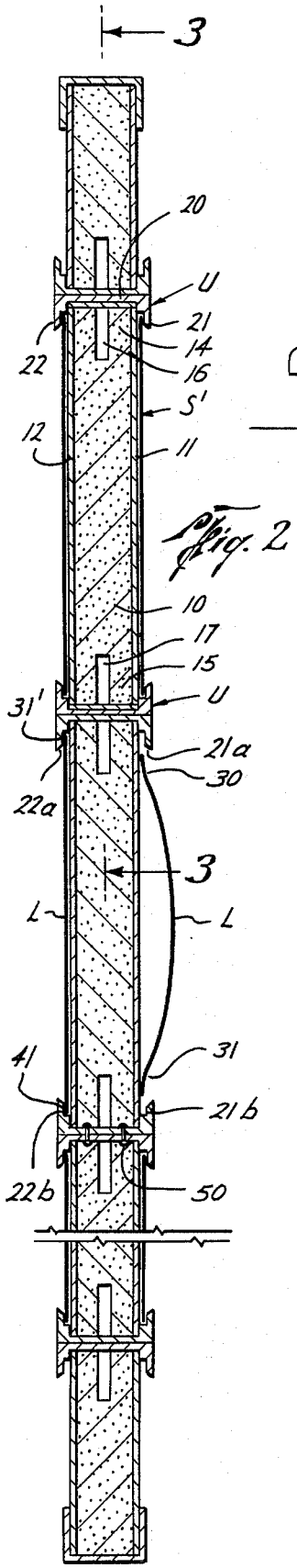
FIG. 2 is a sectional view taken on line 2—2 of FIG. 1 showing details of construction of the sign board.

Considering now the details of construction of one of the segments S', attention is drawn to FIG. 2 of the drawings. As shown there, the segment S' comprises a core block of polystyrene foam material designated 10 and having an outer skin formed of aluminum sheets 11 and 12 affixed to the opposite sides of the foam core block 10 by contact cement or some other suitable adhesive. The upper and lower edges 14 and 15, respectively, of the core block 10 are provided with longitudinally extending grooves or relieved areas 16 and 17, respectively. As shown in FIG. 2, the upper and lower edges of the laminated segment S' are slightly compressed and inserted into the U-shaped channel members U. The grooves 16 and 17 permit the laminated section S to be flexed when compressed slightly at its upper and lower edges when inserted into the U-shaped channel member.

As shown, the upper U-shaped member U comprises a pair of substantially parallel longitudinally extending flange or leg members 21 and 22, respectively, connected at their upper ends with a transversely extending web member 20. The space relationship between such opposed legs 21 and 22 is such that the segment S' must be compressed slightly to be inserted between the flanges 21 and 22. The core block 10 is made of lightweight plastic material, such as polystyrene which is slightly flexible or compressible but which does not permanently deform when slightly compressed.

Normally, the segment S' will be inserted into the U-shaped member U such that the upper or lower edge 14 or 15, as the case may be, is adjacent to or engages the transversely extending web member 20.

The depending legs or flanges 21 and 22, respectively, of the U-shaped member U are formed with recesses or relieved areas **21*a* and 22*a*, respectively, for receiving the edges of the sign letters L. Inwardly and upwardly tapered shoulders 21*b* and 22*b*, respectively, are provided for engaging the upper edges of the substantially plane letter sheets L and guiding them into the recess or relieved area 21*a* or 22*b*, respectively, of the flange members 21 and 22.**

On the righthand side of FIG. 2 a letter L is shown with its upper edge 30 aligned for insertion into the recess or relieved area **21*a* and the lefthand side of FIG. 2 a letter L is shown flat against the sign face 11 with its upper edge 31' inserted into the recess 21*b* and its lower edge 41 inserted into recess 22*b*. This is the position which a letter L will normally occupy when attached to the sign face. It will be appreciated that the body of the individual letter L must be flexed as shown on the righthand side of FIG. 2** to be inserted into the upper and lower recesses of the surrounding U-shaped member U.

It will be appreciated that after the upper and lower edges of the letter L have been inserted into the recesses, such as 22*a* in the U-shaped member U, the letter may then be flattened so as to force the opposite edges into the upper and lower recesses and thereby slightly compress the block 10 to yieldably grip the upper edge 31 of the letter L between the aluminum face 11 and the adjacent lower end 22*d* of the U-shaped member U.

It will further be appreciated that a plurality of the sections S-1, as shown in FIG. 1, may be stacked one above another to provide a sign board of substantially any height that is desired. As shown in FIG. 2, the U-shaped channel members U are positioned with their web portions 20 back to back and secured in that position with rivets 50 or screws, dowel pins or other suitable securing means as desired. Further, it will be appreciated that the sign construction S may either be mounted on the suitable trailer construction shown in FIGS. 2 and 3 and hauled about from place to place or, if desired, the sign structure S may be mounted either on the face of a building or between support poles P or other suitable mounting means as desired. The laminated construction of the present invention provides not only a lightweight yet strong sign board member but also provides a means for frictionally gripping the edges of the letters or words which comprise the copy appearing on the face of the sign. Further, in the event of damage to the face of the sign board, the section S′ may be removed and replaced with a new section simply be removing the rivets or screws which hold that particular section in place in the sign structure.

As shown in FIG. 1, the U-shaped members 20 preferably extend horizontally along the top and bottom of each segment S′ and vertical end members E (also U-shaped channels) are positioned at the opposite ends of the sign board S. With this arrangement the U-shaped channel members U extend around the full parameter of the rectangular segments S′. However, the longitudinally extending grooves 16 and 17 which are provided at the upper and lower edges of the core block 10 are not normally found in the vertical end portions of the block 10.

Figure 3:
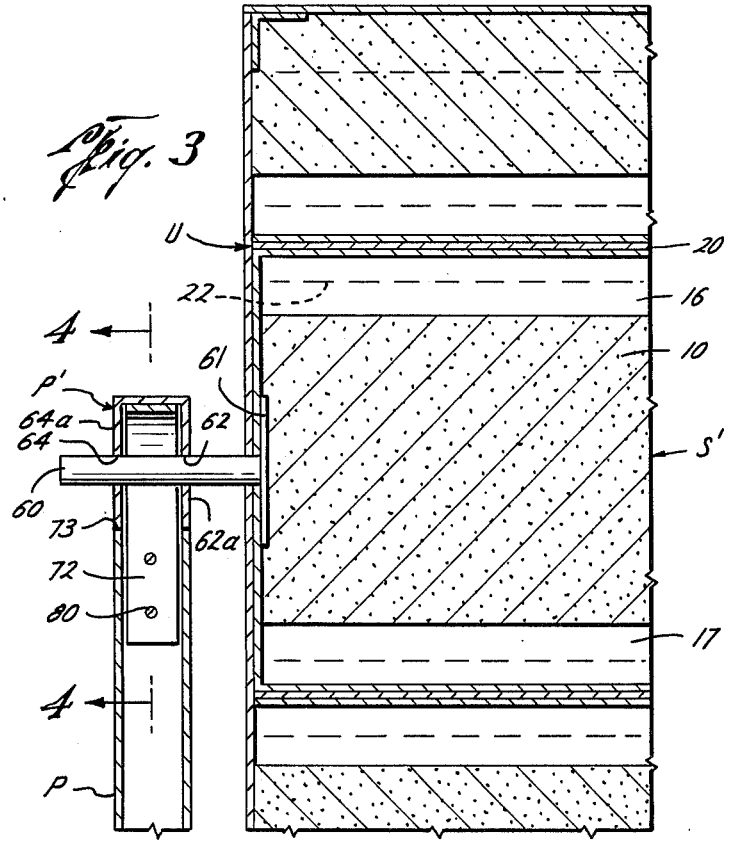
FIG. 3 is a sectional view taken on line 3—3 of FIG. 2 showing means for pivotally mounting the sign board on the trailer.
Figure 4:
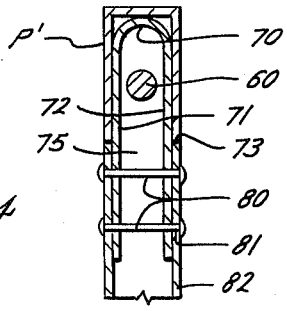
FIG. 4 is a sectional view taken on line 4—4 of FIG. 3 showing additional details of the mounting means for the sign board.

Also shown in the drawings, FIGS. 3 and 4, is an apparatus for pivotally mounting the sign S between poles P. In the configuration thus illustrated, the poles are square in cross-section, however, other shapes could be used. A shaft 60 has its inner end secured to a mounting plate 61 which is positioned inside the segment S′. The shaft projects outwardly through suitable opening in the end member E. The shaft 60 extends through opening 62 and 64 in the opposite side 62*a* and 64*a*, respectively, of the post P′. An inverted U-shaped strap 70 is positioned in the post P′ with legs 71 and 72 extending downwardly below the lower end 73 of such cap for insertion into the open upper end 75 of the post P.

Bolts 80 or pins or other suitbale securing means attach the strap legs 71 and 72 to the post P. Such bolts 80 extend through openings 81 in the post side 82. With this arrangement, the sign board is free to pivot or swing on the axis of the shaft 60.

The foregoing disclosure and description of the invention are illustrative and explanatory thereof, and various changes in the size, shape, and materials as well as in the details of the illustrated construction may be made without departing from the spirit and scope of the invention.

What is claimed is:

1. A laminated two-face sign construction comprising:

a. a core block of substantially rigid slightly resilient compressible foam material;

b. thin metal sheets affixed to opposite sides of said core block and substantially covering the entire surface thereof;

c. U-shaped channel members extending along the upper and lower edges of said core block with the core block slightly compressed and inserted into such U-shaped channel members for holding the upper and lower edges of sheet letters inserted into such channel members on either face of the sign and between such channel member and the adjacent face of the core block with longitudinally extending grooves in the upper and lower edges of said core block to facilitate insertion of letters in said channel members, said sign comprising at least two said core blocks joined together so as to form at least two rows of indicia on either face thereof.

2. The invention of claim 1, wherein said U-shaped channel members include a pair of substantially parallel legs and wherein such legs have relieved areas extending along the inner surface thereof for receiving edges of plane letters inserted into such U-shaped channel member.

3. A laminated two-face sign construction comprising:

a. a core block of substantially rigid slightly resilient compressible foam material;

b. thin metal sheets affixed to opposite sides of said core block and substantially covering the entire surface thereof;

c. U-shaped channel members extending along the upper and lower edges of said core block with the core block slightly compressed and inserted into such U-shaped channel members for holding the upper and lower edges of sheet letters inserted into such channel member on either face of the sign and between such channel member and the adjacent face of the core block with longitudinally extending grooves in the upper and lower edges of said core block; and d. pivot means for mounting said sign board between spaced vertical supports including shaft means projecting from opposite ends of said sign for insertion into caps removably attached to the top of said vertical posts, wherein said caps include:

U-shaped connecting members having a pair of legs depending downwardly below the bottom of said cap for insertion into the top of said vertical support posts.

* * * * *